United States Patent [19]

Lecoffre

[11] 4,226,705

[45] Oct. 7, 1980

[54] METHOD OF PRODUCING MICROBUBBLES FOR TREATING A SUSPENSION

[75] Inventor: Yves Lecoffre, Domene, France

[73] Assignee: Alsthom-Atlantique, Paris, France

[21] Appl. No.: 922,700

[22] Filed: Jul. 7, 1978

[30] Foreign Application Priority Data

Jul. 26, 1977 [FR] France ..... 77 22873

[51] Int. Cl.[2] ..... B03D 1/14

[52] U.S. Cl. ..... 209/164; 209/170; 210/220

[58] Field of Search ..... 209/164, 165, 168, 170; 210/220, 221; 261/DIG. 75, 121 R, 81

[56] References Cited

U.S. PATENT DOCUMENTS

| | | | |
|---|---|---|---|
| 1,240,824 | 9/1917 | Clauson | 209/169 X |
| 1,515,942 | 11/1924 | Eldred | 209/168 X |
| 1,706,281 | 3/1929 | Elmore | 209/168 X |
| 2,093,898 | 9/1937 | Taplin | 209/164 X |
| 2,142,207 | 11/1939 | Price | 209/168 X |
| 2,995,497 | 8/1961 | Heden | 261/121 R X |
| 3,246,761 | 9/1966 | Bryan | 261/121 R X |
| 3,628,775 | 12/1971 | McConnell | 210/220 X |

FOREIGN PATENT DOCUMENTS

| | | | |
|---|---|---|---|
| 2700754 | 7/1977 | Fed. Rep. of Germany | 210/220 |
| 859994 | 9/1940 | France | 209/166 |
| 2115053 | 7/1972 | France | 261/121 R |
| 210245 | 1/1924 | United Kingdom | 209/170 X |
| 505688 | 3/1939 | United Kingdom | 209/170 |
| 216636 | 9/1971 | U.S.S.R. | 261/81 |

*Primary Examiner*—Robert Halper

*Attorney, Agent, or Firm*—Sughrue, Rothwell, Mion, Zinn and Macpeak

[57] ABSTRACT

A method of producing bubbles for treating a suspension by flotation, wherein in which the suspension enriched with dissolved gas is caused to flow into a flotation vat via a pipe the flow in the pipe is rapidly interrupted at a predetermined frequency by a shutter unit which is suddenly closed and produces, in the downstream portion of the pipe, a periodic wave of low pressure such that cavitation bubbles are produced in the flow in said downstream portion, the low pressure wave propagating in the pipe up to the flotation vat where it is reflected as a wave of high pressure which produces the collapse of the cavitation bubbles and forms micro-bubbles which become fixed to the particles to be floated, the conditions in the pipe being such that the micro-bubbles are in a super-saturated medium in relation to the local pressure conditions and tend to be enlarged during their flow up to the flotation vat.

4 Claims, 2 Drawing Figures

METHOD OF PRODUCING MICROBUBBLES FOR TREATING A SUSPENSION

BACKGROUND OF THE INVENTION

An effluent can be purified, or more generally a suspension which contains particles (or droplets) can be separated, by the flotation method in which bubbles are produced which are liable to become fixed on these particles to bring them to the surface by bouyancy thrust.

SUMMARY OF THE INVENTION

The present invention provides a method of producing bubbles for treating a suspension by flotation, wherein in which, the suspension enriched with dissolved gas is caused to flow into a flotation vat via a pipe, the flow in the pipe is rapidly interrupted at a predetermined frequency by a shutter unit which is suddenly closed and produces, in the downstream portion of the pipe, a periodic wave of low pressure such that cavitation bubbles are produced in the flow in said downstream portion, the low pressure wave propagating in the pipe up to the flotation vat where it is reflected as a wave of high pressure which produces the collapse of the cavitation bubbles and forms micro-bubbles which become fixed to the particles to be floated, the conditions in the pipe being such that the micro-bubbles are in a super-saturated medium in relation to the local pressure conditions and tend to be enlarged during their flow up to the flotation vat.

Further, advantageously, in accordance with the method described in French patent application No. 77 22 234 filed by the Applicant on July 20, 1977, a vacuum can be formed in the free space above the surface of the suspension in the flotation vat, further enlarging the bubbles by gaseous diffusion in this vat when they rise towards the free surface, thus ensuring that the particles are more effectively drawn off.

In acordance with a particular embodiment which provides an extra advantage, and in accordance with said French patent application, a vacuum can be formed in the flotation vat by a siphon effect without any great consumption of energy by placing said vat above the supply level of the suspension and by connecting it to the tank by a pipe with an upward flow downstream from the rapidly shutting valve, said suspension being removed, after treatment in the vat, through a pipe coming from a lower level than the supply level.

Only a low-power vacuum pump is needed to prime the siphon and maintain this vacuum by removing the air brought into the vat by the bubbles which pass through the free surface.

Two embodiments of the invention are described hereinbelow by way of example with reference to the accompanying drawings.

DESCRIPTION OF THE PREFERRED EMBODIMENTS

Figure 1:
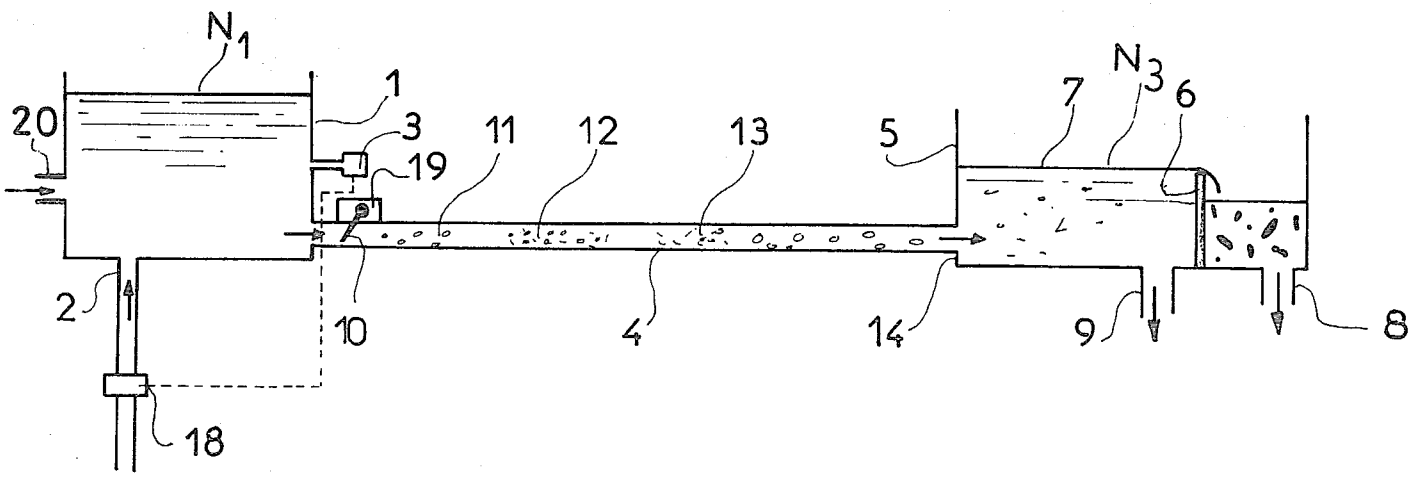
FIG. 1 is a sectional view of an installation in accordance with the invention.

FIG. 1 shows an embodiment in accordance with the invention of a system for purifying an effluent by the flotation method; comprising a tank 1 fed through a pipe 20 with effluent to be treated which is kept at a level $N_1$ by conventional detection and control devices, not shown.

This tank includes an air inlet 2 to obtain a saturated air and effluent solution. This saturated solution is checked by a measuring device 3 which controls an air injection regulator 18.

This effluent is brought, via a pipe 4 which has a rapidly closing valve 10, to the base of a flotation vat 5 which comprises an overflow-shoot over which the particles which have been brought to the surface 7 of the effluent in the flotation vat flow with the liquid, these particles being evacuated through a pipe 8. The level in the flotation vat is kept by means of the overflow-shoot 6 at $N_3$, which is lower than the level $N_1$ of the feed tank 1.

The treated effluent is removed from the vat 5 through a pipe 9.

A periodic pressure reduction wave forming cavitation bubbles 11 in the pipe 4 is produced downstream from the valve 10 by shutting it at a predetermined frequency by means of a control unit 19 which rapidly shuts off the flow at this frequency.

This wave propagates to the downstream end 14 of this pipe to reach the free surface 7 of the effluent in the flotation vat 5 and is reflected in this flotation vat subsequent to the great discontinuity of acoustic impedance which occurs therein and forms a pressure wave in the pipe 4, causing collapse of the cavitation bubbles and the formation of micro-bubbles 12 which are liable to become attached to the particles of effluent which are to be floated.

The effluent in the tank 1 is saturated with dissolved air; this saturation is checked by the measuring device 3 which controls an air injection regulator 18, so that the bubbles in the pipe 4 are in a super-saturated medium in relation to the local pressure conditions and are enlarged at 13 during their travel up to the flotation vat, where they rise and become fixed to the particles to bring them to the free surface 7, these particles then being evacuated over the overflow-shoot 6 and through the pipe 8.

Figure 2:
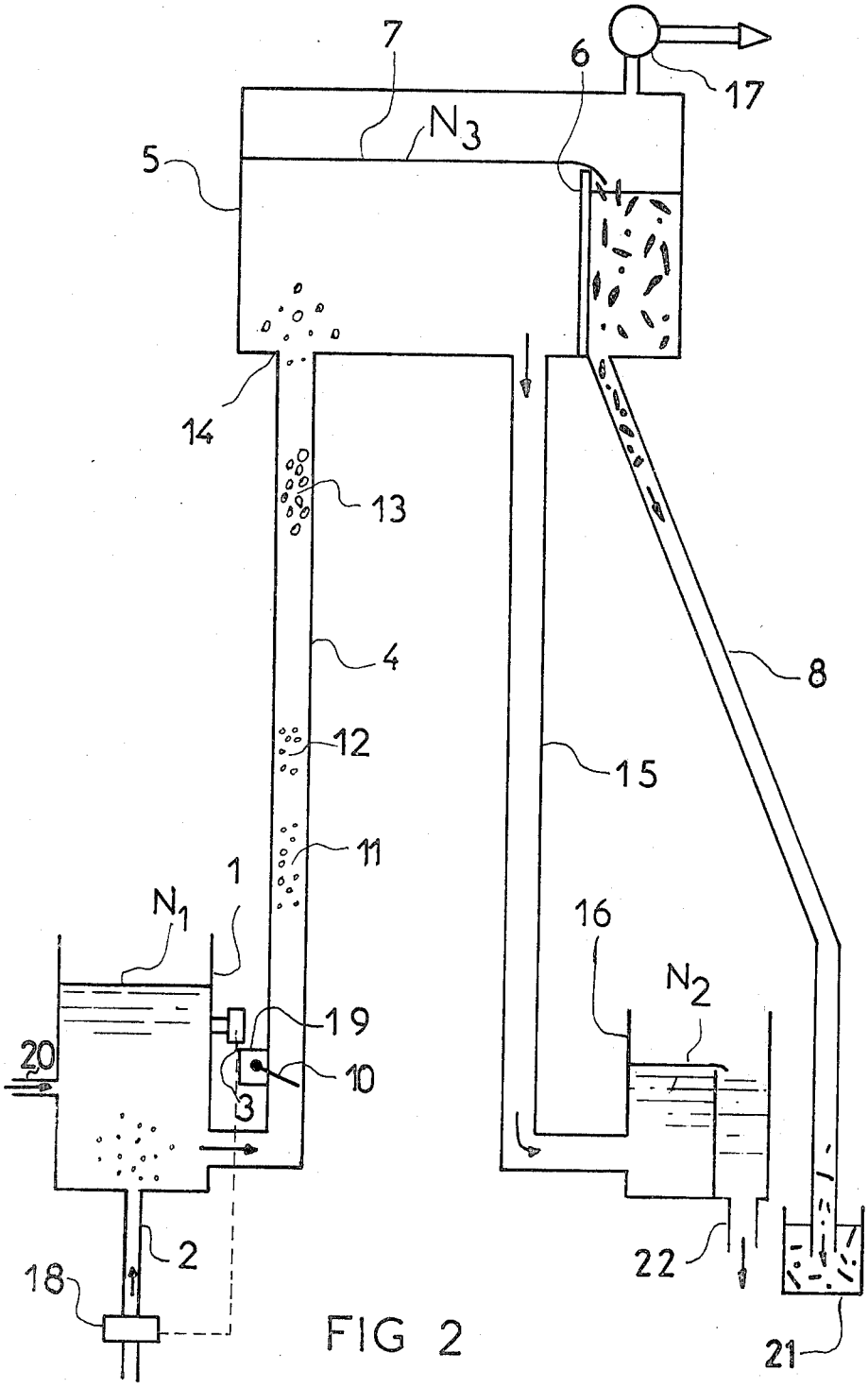
FIG. 2 is a schematic sectional view of a variant of the invention.

FIG. 2 shows a variant embodiment in which the free space above the surface of the effluent in the flotation vat forms a vacuum by a siphon effect.

This figure shows the feed tank 1 for the effluent which is to be treated, with its air inlet 2 controlled by devices 3 and 18, the level of the effluent in this tank being kept at $N_1$ by conventional detection devices and control devices, not shown.

The flotation vat is placed above the level $N_1$ of the feed tank 1 and is connected thereto by the pipe 4 which is then vertical, with an upward flow; it has at its base the rapidly closing valve 10.

The particles are evacuated from the flotation vat through the pipe 8 which leads into a vat 21 and the treated effluent is removed through a vertical pipe 15 with a downward flow which brings said effluent into a tank 16 whose level is at $N_2$ and is lower than the level $N_1$ of the effluent in the feed tank 1. The treated effluent is evacuated from this tank through a pipe 22.

In these conditions, the effluent flows from the tank 1 to the tank 16 due to a siphon effect; this forms a vacuum in the free space above the surface 7 of the effluent in the flotation vat 5.

The installation operates in the same way as in the example of FIG. 1; the valve 10 closes rapidly and thus produces a pressure wave which forms cavitation bubbles 11 in the pipe 4 and which is reflected from the flotation tank 5 as a pressure wave which causes the bubbles 11 to collapse and to form micro-bubbles 12 which are enlarged at 13 in the path up to the flotation vat 5.

A low-power vacuum pump 17 primes the siphon and maintains this pressure while extracting the air brought into the vat by the bubbles which pass through the free surface.

Due to the vacuum in the vat 5, the micro-bubbles are enlarged by the combined effect of the vacuum and of gaseous diffusion in the upward flow pipe 14, while the bubbles flow towards the flotation vat 5; thus, in this vat, the bubbles are further enlarged by gaseous diffusion until they are relatively big and the particles of effluent are brought very effectively to the free surface 7.

What is claimed is:

1. A method of producing bubbles for treating a suspension by flotation, said method comprising the steps of:

saturating the suspension with dissolved gas, causing the saturated suspension to flow through a pipe bearing a shutter valve into a flotation vat below the surface level of the suspension accumulating within said vat, maintaining the pressure downstream of said shutter valve lower than the pressure upstream thereof to cause the suspension to be supersaturated downstream of said shutter valve, rapidly interrupting the flow in the pipe by opening and closing said shutter valve at a predetermined frequency to produce, when the shutter valve is closed, in the downstream portion of the pipe, a periodic wave of low pressure such that cavitation bubbles are produced in the flow of said supersaturated suspension in said downstream portion, said periodic wave during shutter valve closing propagating a low pressure wave in the pipe up to the flotation vat where it is reflected as a wave of high pressure which produces the collapse of the cavitation bubbles and forms micro-bubbles which become fixed to the particles to be floated and tend to be enlarged during flow up to the flotation vat with said particles.

2. A method according to claim 1, further comprising the step of forming a vacuum in the free space above the surface of the suspension in the flotation vat.

3. A system for producing bubbles for treating a suspension by flotation, said system comprising:

a flotation vat, a pipe bearing a shutter valve and leading to said flotation vat and opening to said flotation vat at a level beneath the surface of suspension accumulating within said vat and supplying the suspension saturated with dissolved gas to said vat, means for maintaining the pressure downwstream of the shutter valve lower than the pressure upstream of the shutter valve to cause the suspension to be super-saturated downstream of the shutter valve, means for suddenly closing said shutter valve for rapidly interrupting the flow in the pipe at a predetermined frequency to produce, during closure of said shutter valve, in the pipe downstream of the shutter valve, a periodic wave of low pressure such that cavitation bubbles are produced in the flow in said downstream portion, thereby, propagating a low pressure wave during shutter valve closing in the pipe up to said flotation vat where it is reflected as a wave of high pressure which produces the collapse of the cavitation bubbles and forms micro-bubbles which become fixed to the particles to be floated, with said micro-bubbles being in a super-saturated medium in relation to the local pressure conditions and tending to be enlarged during their flow up to said flotation vat, and said system further comprising an overflow-chute within said flotation vat over which the floated particles pass and means upstream from said overflow-shoot to remove the purified suspension and means downstream from the overflow-chute to remove the floated particles.

4. The system as claimed in claim 3, wherein said flotation vat is fluid-tight such that a vacuum is formed in the space above the surface of the suspension by siphon effect, and said vat is placed above the supply level $N_1$ of the suspension and is connected to the supply level by a pipe with an upward flow downstream from the rapid shutter unit, and means for removing the suspension after treatment in the vat through a second pipe which descends to a level $N_2$ which is lower than the supply level $N_1$, and wherein suction means are provided for priming the vacuum and maintaining the vacuum.

* * * * *